US011123652B2

(12) United States Patent
Haldeman

(10) Patent No.: US 11,123,652 B2
(45) Date of Patent: Sep. 21, 2021

(54) MODULAR CUBE BUILDING BLOCK SYSTEM

(71) Applicant: Drew Haldeman, Auburn, CA (US)

(72) Inventor: Drew Haldeman, Auburn, CA (US)

( * ) Notice: Subject to any disclaimer, the term of this patent is extended or adjusted under 35 U.S.C. 154(b) by 0 days.

(21) Appl. No.: 16/871,009

(22) Filed: May 10, 2020

(65) Prior Publication Data

US 2020/0360831 A1 Nov. 19, 2020

Related U.S. Application Data

(60) Provisional application No. 62/849,026, filed on May 16, 2019.

(51) Int. Cl.
*A63H 33/08* (2006.01)

(52) U.S. Cl.
CPC ..... *A63H 33/086* (2013.01); *A63H 33/084* (2013.01)

(58) Field of Classification Search
CPC ..... A63H 33/06; A63H 33/08; A63H 33/082; A63H 33/084
See application file for complete search history.

(56) References Cited

U.S. PATENT DOCUMENTS

| | | | | |
|---|---|---|---|---|
| 4,676,762 | A * | 6/1987 | Ballard | A63H 33/105 446/104 |
| 7,900,930 | B2 | 3/2011 | Donegan | |
| 7,988,516 | B2 * | 8/2011 | Bishop | A63H 33/082 446/85 |
| 8,387,989 | B2 | 3/2013 | Baum | |
| 8,715,029 | B2 * | 5/2014 | Bishop | A63H 33/084 446/85 |
| 9,238,179 | B2 * | 1/2016 | Carpenter | A63H 33/062 |
| 9,873,036 | B2 | 1/2018 | Gruber | |
| 10,232,280 | B2 | 3/2019 | Koyun | |
| 10,724,240 | B2 * | 7/2020 | Brandao | A63H 33/084 |
| 2007/0178800 | A1 * | 8/2007 | Kim | A63H 33/084 446/124 |
| 2016/0339351 | A1 | 11/2016 | Akishbekov | |
| 2020/0215450 | A1 * | 7/2020 | Saltan | A63H 33/062 |

FOREIGN PATENT DOCUMENTS

| | | |
|---|---|---|
| WO | WO2001056677 | 8/2001 |

* cited by examiner

*Primary Examiner* — John A Ricci
(74) *Attorney, Agent, or Firm* — Jim H. Salter; Inventive Law Inc.

(57) ABSTRACT

A modular cube building block system is disclosed. An example embodiment includes: a modular cube building block comprising: a coupler including a coupler channel formed between a plurality of fins; and a plurality of nodes integrated or attached with the coupler, the plurality of nodes being cubes arranged in orthogonal rows and columns, a space between the plurality of nodes defining a T-channel configured to capture a coupler of a different modular cube building block, the coupler channel configured to capture a node group of a different modular cube building block.

10 Claims, 22 Drawing Sheets

MODULAR CUBE BUILDING BLOCK SYSTEM

PRIORITY PATENT APPLICATION

This non-provisional patent application draws priority from U.S. provisional patent application Ser. No. 62/849,026; filed May 16, 2019. The entire disclosure of the referenced patent application is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2019-2020, Drew HALDEMAN; All Rights Reserved.

TECHNICAL FIELD

The disclosed subject matter generally relates to a multiple player modular cube building block system comprising a number of cubes or modules, several of which are interconnected into groups of cubes capable of being assembled into building blocks for structural construction as well as adaptation to other uses.

BACKGROUND

Building blocks can be assembled in many ways to construct many different objects and shapes and anything constructed can then be taken apart. Building blocks are a benefit for children because they improve eye-hand coordination and encourage imagination.

Educators concerned with the education not only of architects and interior designers but also of the very young are particularly interested in the educational value of modular design units. Such units have great value in teaching principles of construction and design, in facilitating visualization and evaluation of proposed designs, and in fostering an appreciation of color and form.

Conventional building blocks use a simplistic interconnection mechanism that is too weak for larger assemblies. Moreover, conventional building block systems do not facilitate or support the construction of complex three-dimensional (3D) assemblies.

SUMMARY

A modular cube building block system is disclosed. An example embodiment includes modular cubes or modules that act as building blocks that attach by fins fitting into undercuts and can also connect around protruding corners. When mounted to a heavy object, such as a dining room table, the blocks are able to self-support and cantilever up and over large distances. This allows for an infinite amount of connections and configurations to be built seemingly suspended in mid-air. Blocks can be used to build horizontal and vertical fields. They also connect to one another with six possible connections per side. These connections are the four corners, as well as the two converging center lines per side. The grid face, made of recessed dividing gaps, allows for the connection fins to slide into each block and make a stable connection. The components must be slid apart in the correct direction to detach from one another.

The block is a six sided cube. Each face of the cube is composed of sixteen squares that are across. These squares are divided by deep grooves. The two converging center axis' grooves on each face are wide and deep. These grooves contain a T-shaped undercut. The recesses are formed by the undercut. The bottom of the groove with the undercuts extends crosswise. The deeper grooves with the undercuts dissect each face of the cube into four quadrants of four squares. All of the grooves continue around the entirety of the cube, on each face, and this creates cubes that form the perimeter corners of each face. The grooves parallel to one another, shared by two faces in line with, and perpendicular to each other, create a cube-shaped corner. The parallel grooves that create two of the edges of these cube-shaped corners, act as grip-holds for the slide connector piece, making corner connections possible. Not only do connectors fit into the centerline axes, but they can also grab onto the outer edges of the cubes as well. This enables multiple planes of creative construction.

All connections involve an "under-cut" of some kind. Either a grip around a corner, or a t-fin slipping under the interior undercut of the block. However, the same connector works for both corner and centerline connections. In various example embodiments, there are three different types of cubes. The first has no connectors permanently attached to it. The second type has a connector on one side, and the third has three connectors attached that wrap around the corner of two faces connecting both centerlines. The last piece is used for constructing fields, the middle is for building in a single direction up, down, left, and right, and the first is to hide fins that builders do not want to see.

It is important to note that the blocks do not snap together; they removably slide into one another. This means that the pieces only come apart along a certain direction of pull. They do not pop apart, which allows for a stable connection over distances that existing building blocks cannot achieve. In other words, the structure is as stable as the base it is mounted to. This stability allows for a new dimension in building. Structures can be built in all directions. Creations mounted to a heavy object, such as a table top, can span across the surrounding room and up into the ceiling corners.

Not only does the grid system enable each piece to connect together, but it also allows architectural and beatification items to be fit into the face of each block. This clip in feature allows figures and objects to be placed on the modular structure whether they are level, perpendicular, or opposite of the current gravitational force.

A principal object of the example embodiments is to provide a new cube puzzle for assembling the desired three dimensional structures, which excites a player's interest greatly and furthers the development of the player's imagination. Another object of the example embodiments is to provide a new cube puzzle for assembling the desired structures, which can be used or played by those of any age.

Another object of the example embodiments is to provide a new cube puzzle building system whereby a desired three dimensional structure can be erected. Another object of the example embodiments is to provide a new puzzle whereby the desired plane characters such as animals, bipeds or flowers can be assembled.

Therefore, an object of the example embodiments is the provision of an improved building block system comprising a number of different pieces, each piece being a different arrangement of a group of cubic units.

The modular cube building block system as disclosed herein overcomes the drawbacks of the prior art in that it greatly simplifies the mass fabrication of the cubes as well as the ease of arranging cube groupings about another cube or cube grouping. The various example embodiments are described in more detail below.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

Figure 1:
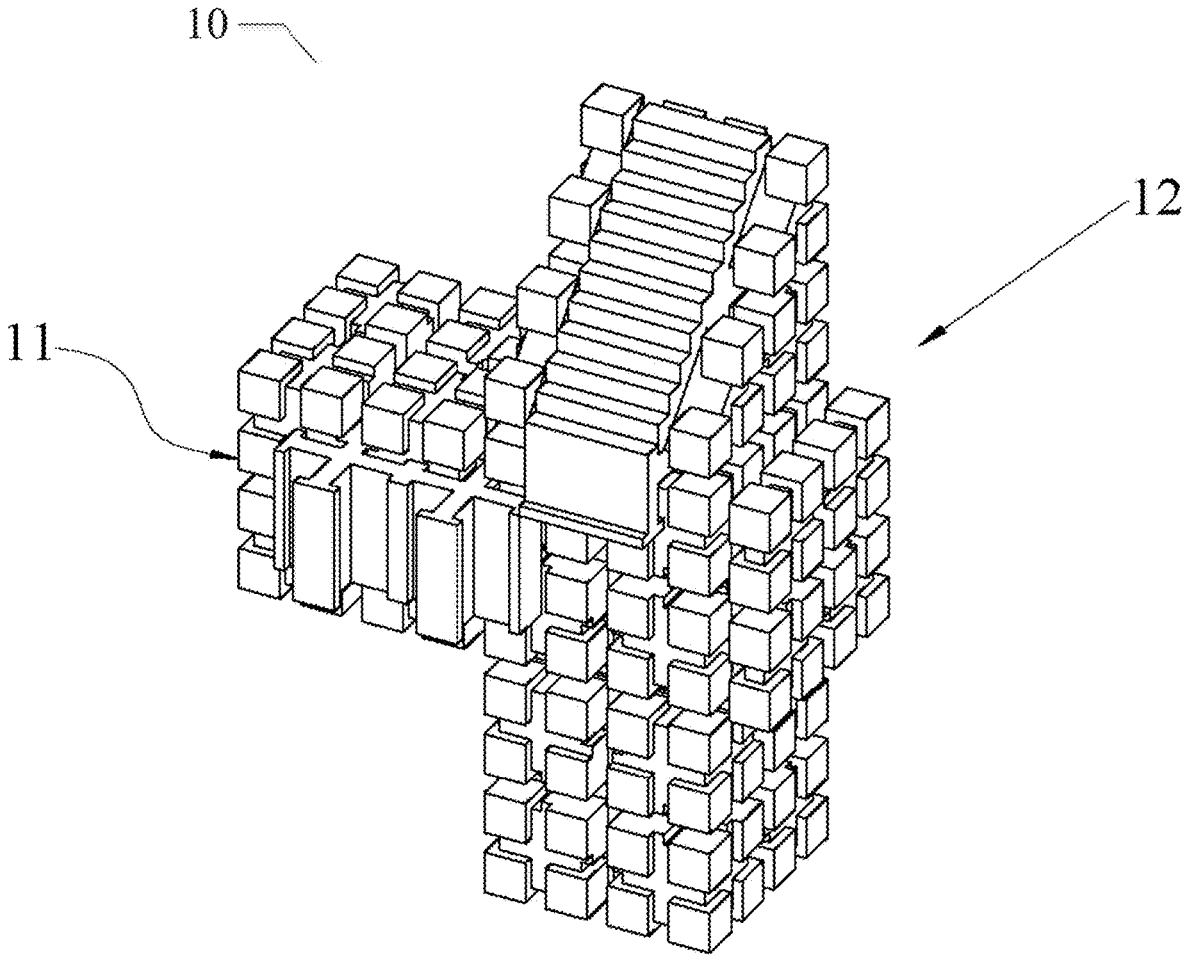
FIG. 1 is a perspective view of the basic assembly concept of an example embodiment.
Figure 2:
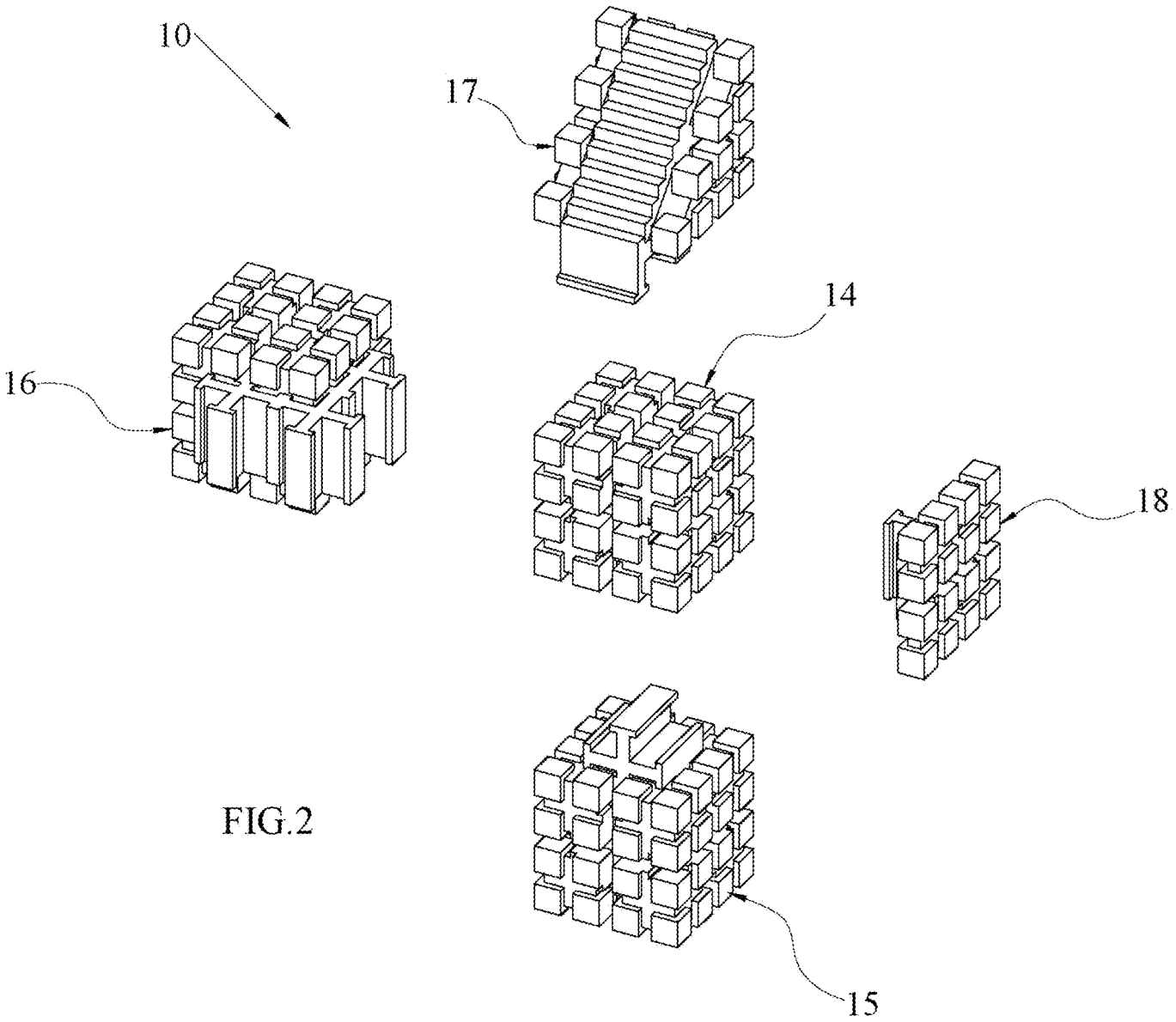
FIG. 2 is an exploded view of the each of the individual pieces of an example embodiment.
Figure 3:
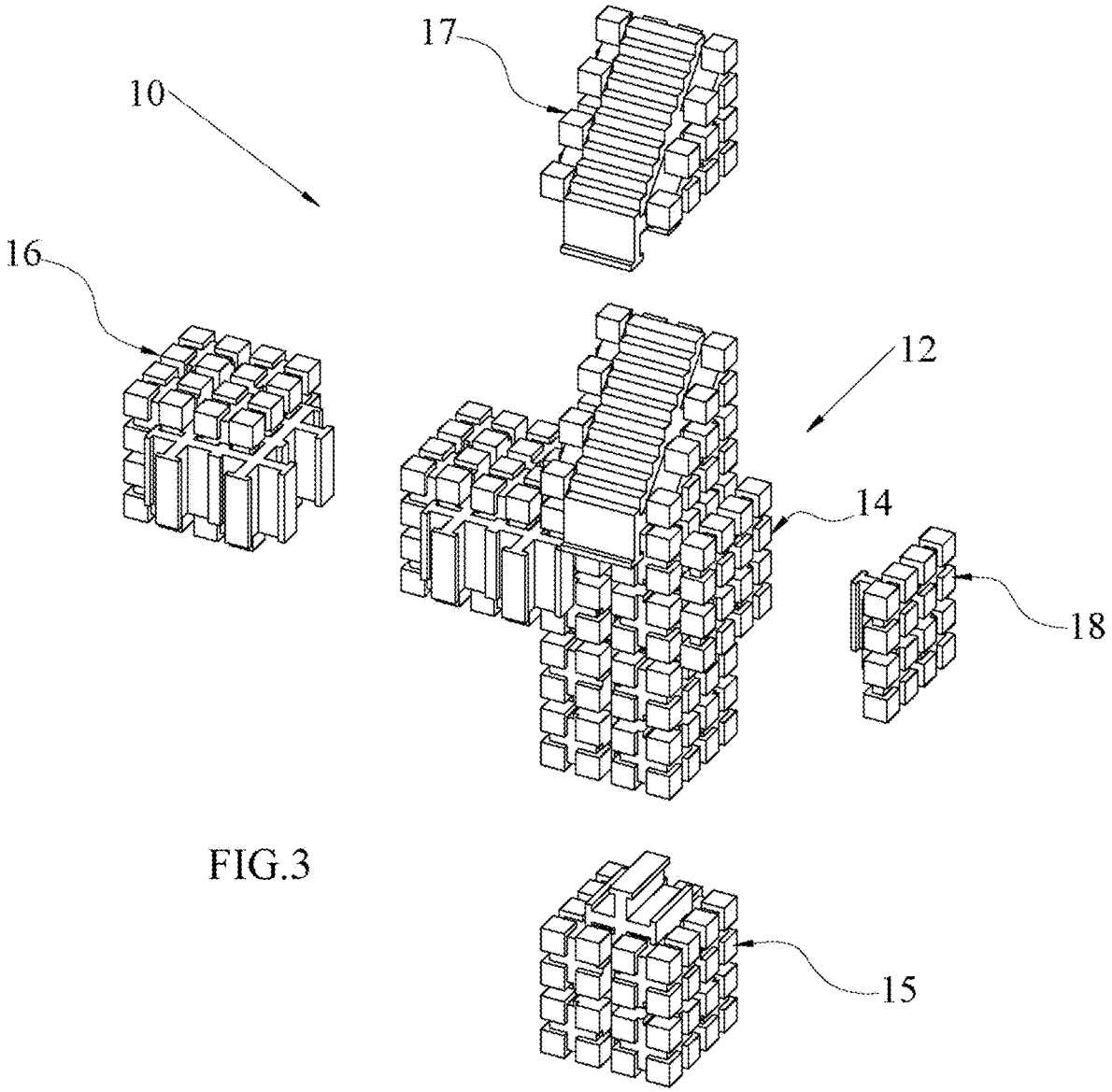
FIG. 3 is a perspective view of each piece showing, respectively, each piece representative ways in which the cube of FIG. 1 can be nested together.
Figure 4:
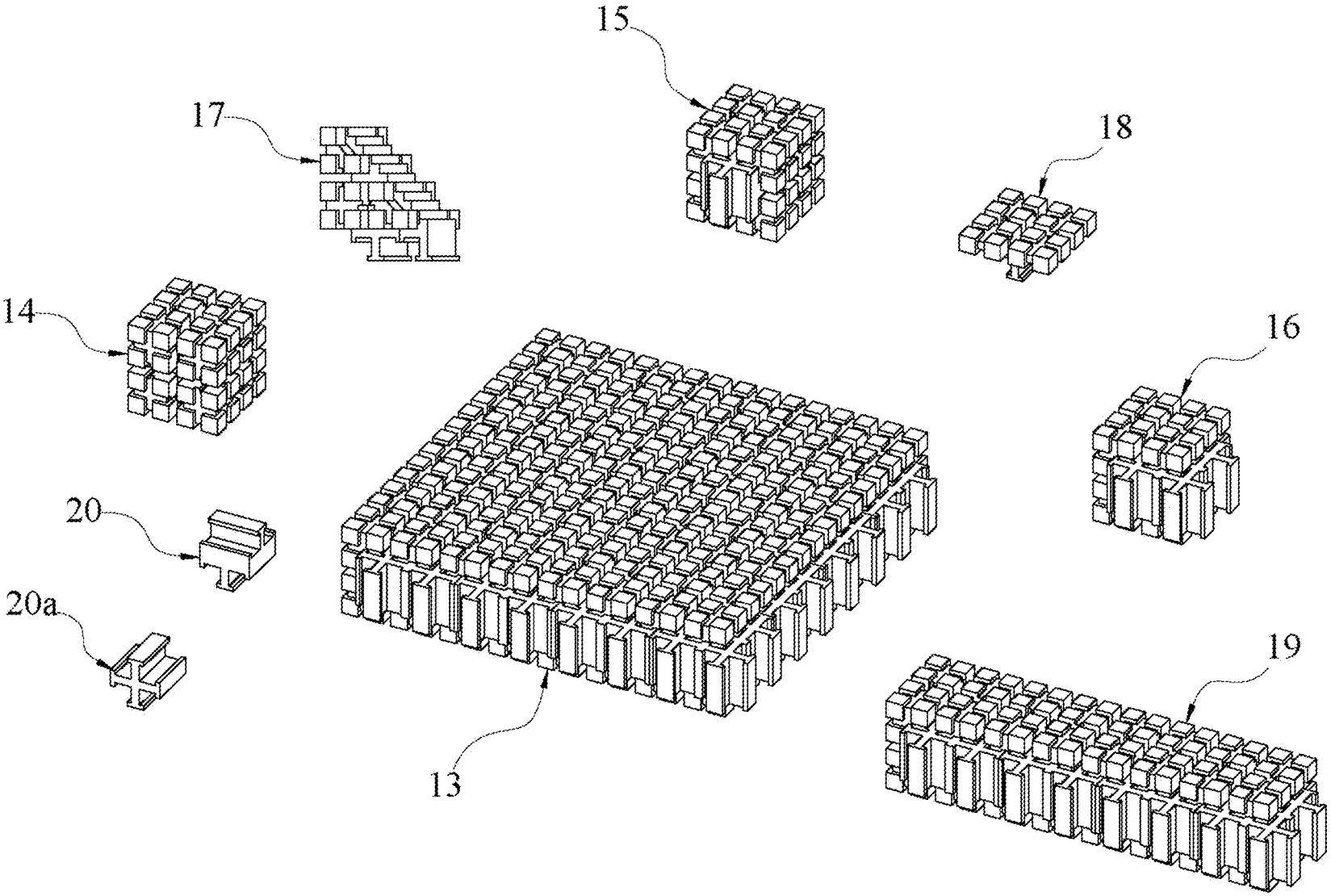
FIG. 4 is a perspective view of a plurality of individual pieces which can form a three-dimensional (3D) structural unit in accordance with an example embodiment.
Figure 5:
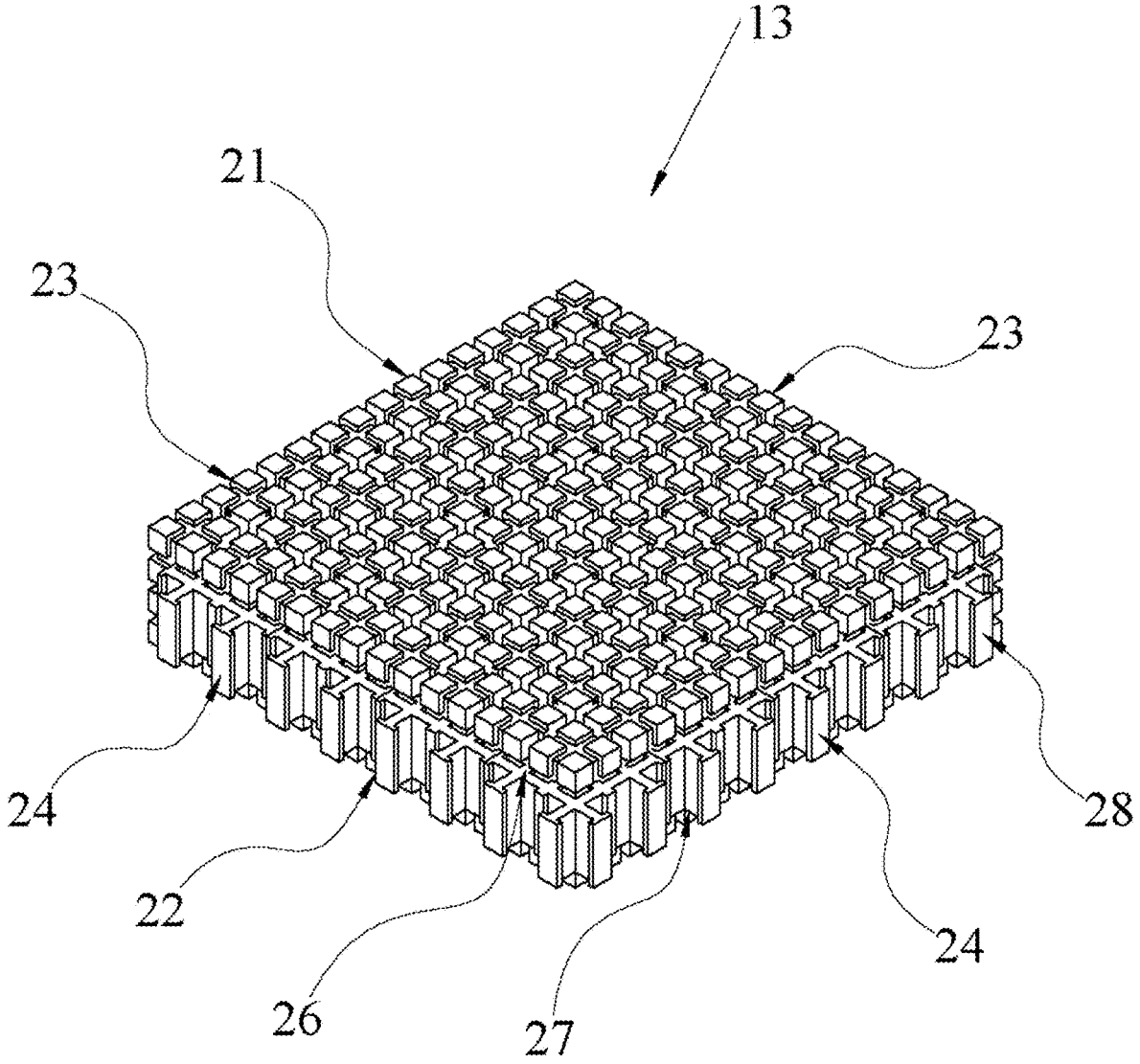
FIG. 5 is a perspective view of the single cube base plate of an example embodiment.

In various example embodiments disclosed and illustrated herein, a modular cube building block system 10 is described. Referring to FIG. 1, an example embodiment of the modular cube building block system 10 includes at least one modular cube 11 as a building temple guide piece, a plurality of building blocks 12 forming a free standing structural unit. FIG. 2 is an exploded view of each of the individual modular cube pieces of the building block system 10, which includes a standard cube piece 14, specialized single fin cube 15, specialized dual fin cube 16, specialized stair cube 17 and a standard single fin cube 18. As shown in FIG. 3, a first type of building block 10 assembled from a plurality of building blocks 12 is shown having standard cube piece 14, specialized single fin cube 15, specialized dual fin cube 16, specialized stair cube 17 and a standard single fin cube 18 positioned in proximity to the building block 12 forming the illustrated structure. FIG. 4 shows an example of the start of the construction of a three-dimensional building block structure, including the various pieces positioned adjacent to the single cube base plate 13 as shown. These pieces include a standard cube piece 14, specialized single fin cube 15, specialized dual fin cube 16, specialized stair cube 17, connector fin cube piece 20/20*a*, a standard single fin cube 18, and a partially constructed block structure 19. Each of the pieces can be positioned anywhere on the single cube base plate 13 to start the building process. As shown in FIG. 5 the single cube base plate 13 is a square structure and comprises a top grid face 21, bottom grid face 22, two side grid faces 23 and two side connectors 24. The top grid face 21, bottom grid face 22 and the two side grid faces 23 includes multiple square protrusions 25 extending from an outer surface thereof. Each surface has an interior undercut 26 on the grid face. The two side connectors 24 include an undercut 27, and a T-shaped fin 28 for slipping under the interior undercut 26 of the grid faces.

Figure 6:
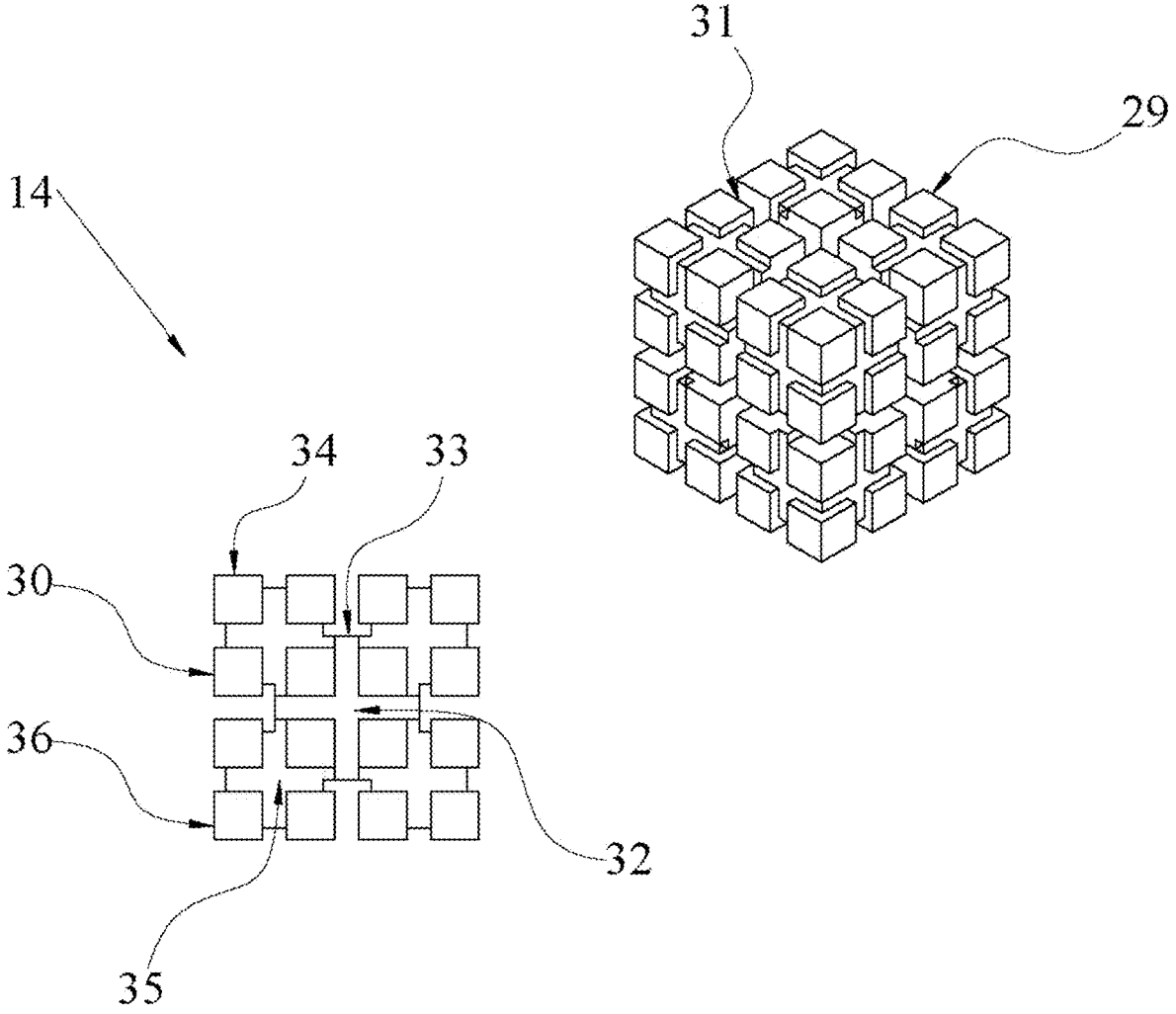
FIG. 6 shows the front, right, and top views of standard cube piece of an example embodiment.
Figure 7:
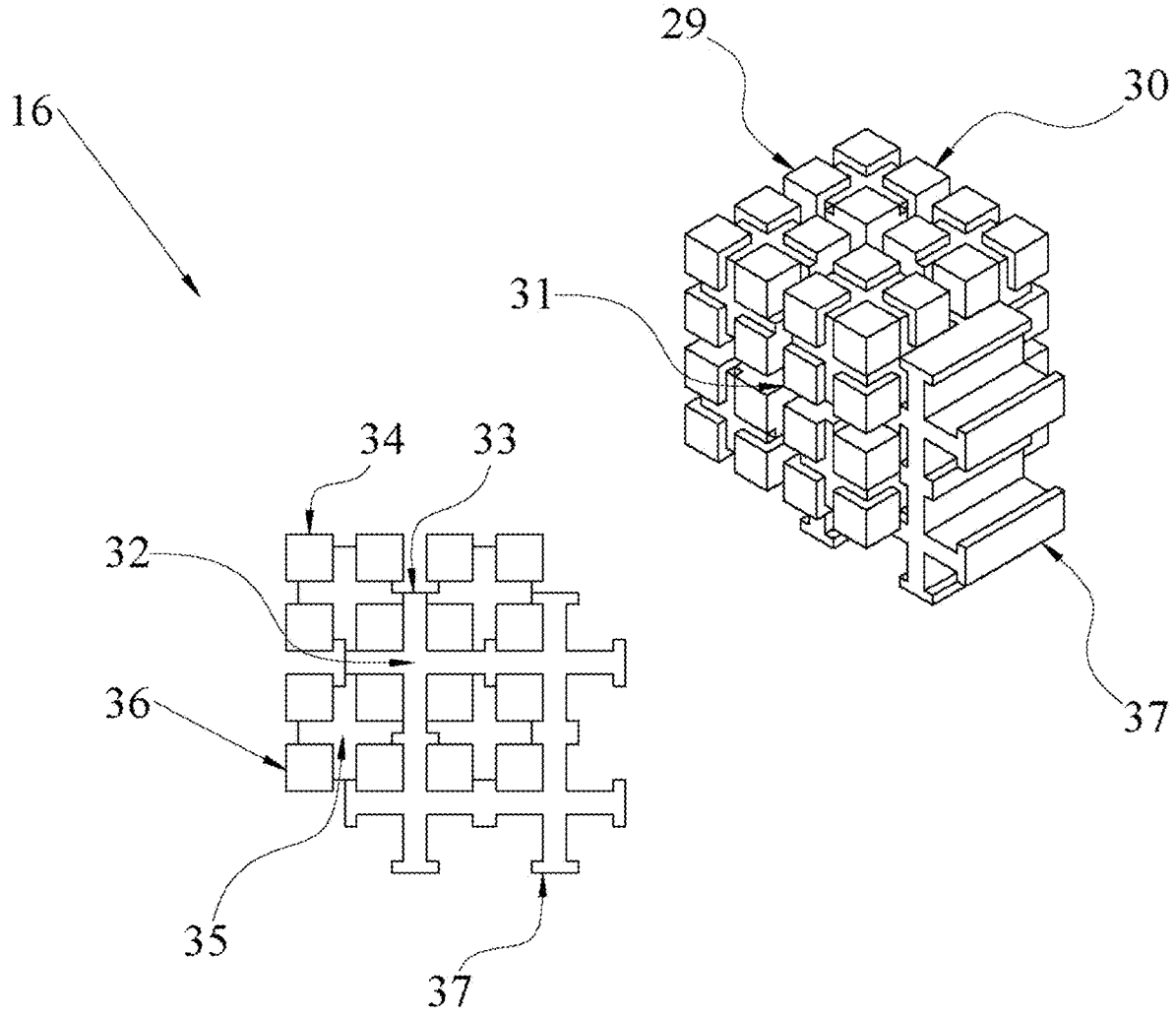
FIG. 7 shows the front, right, and top views of specialized dual fin cube piece of an example embodiment.
Figure 8:
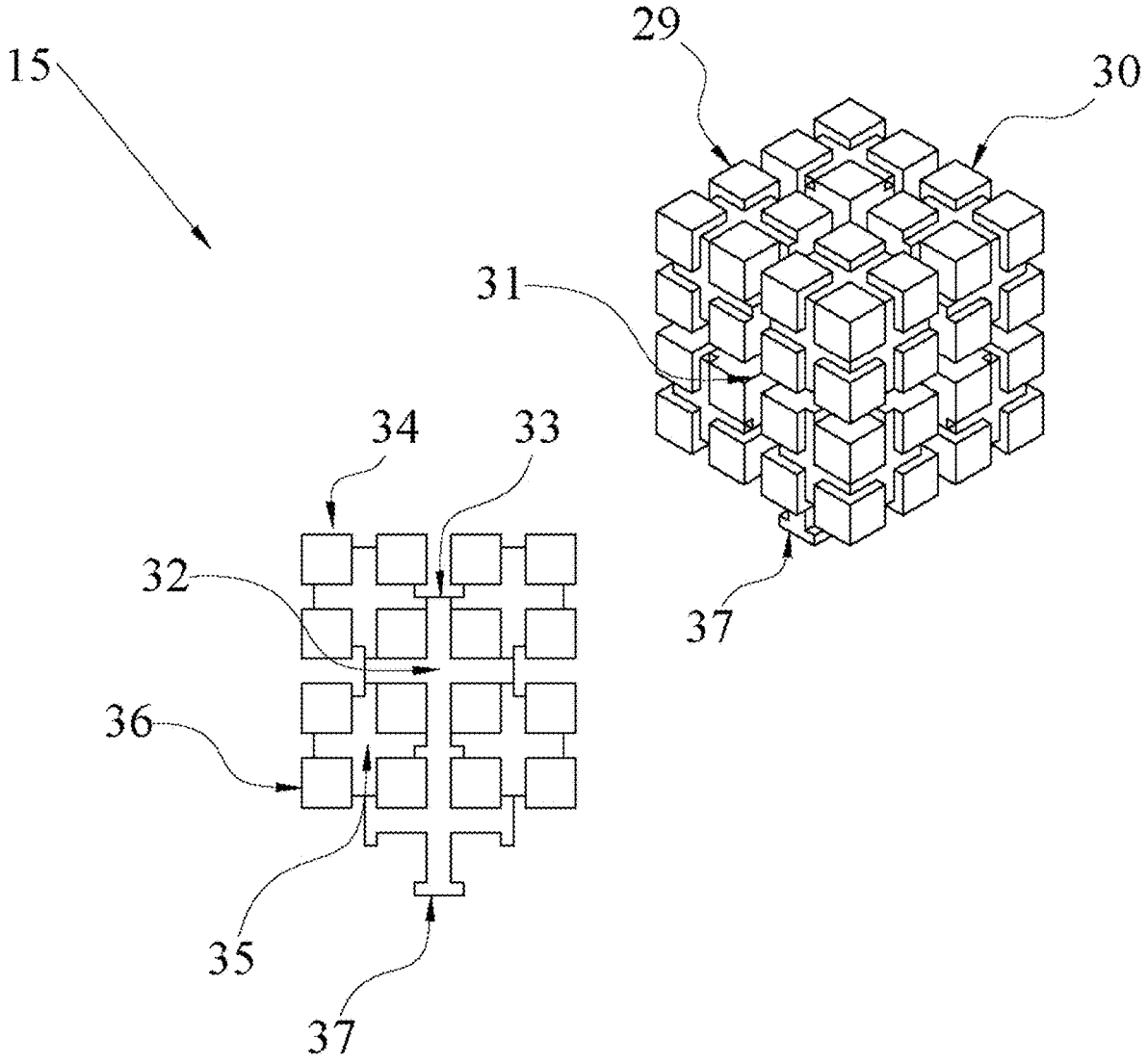
FIG. 8 shows the front, right, and top views of specialized single fin cube piece of an example embodiment.
Figure 9:
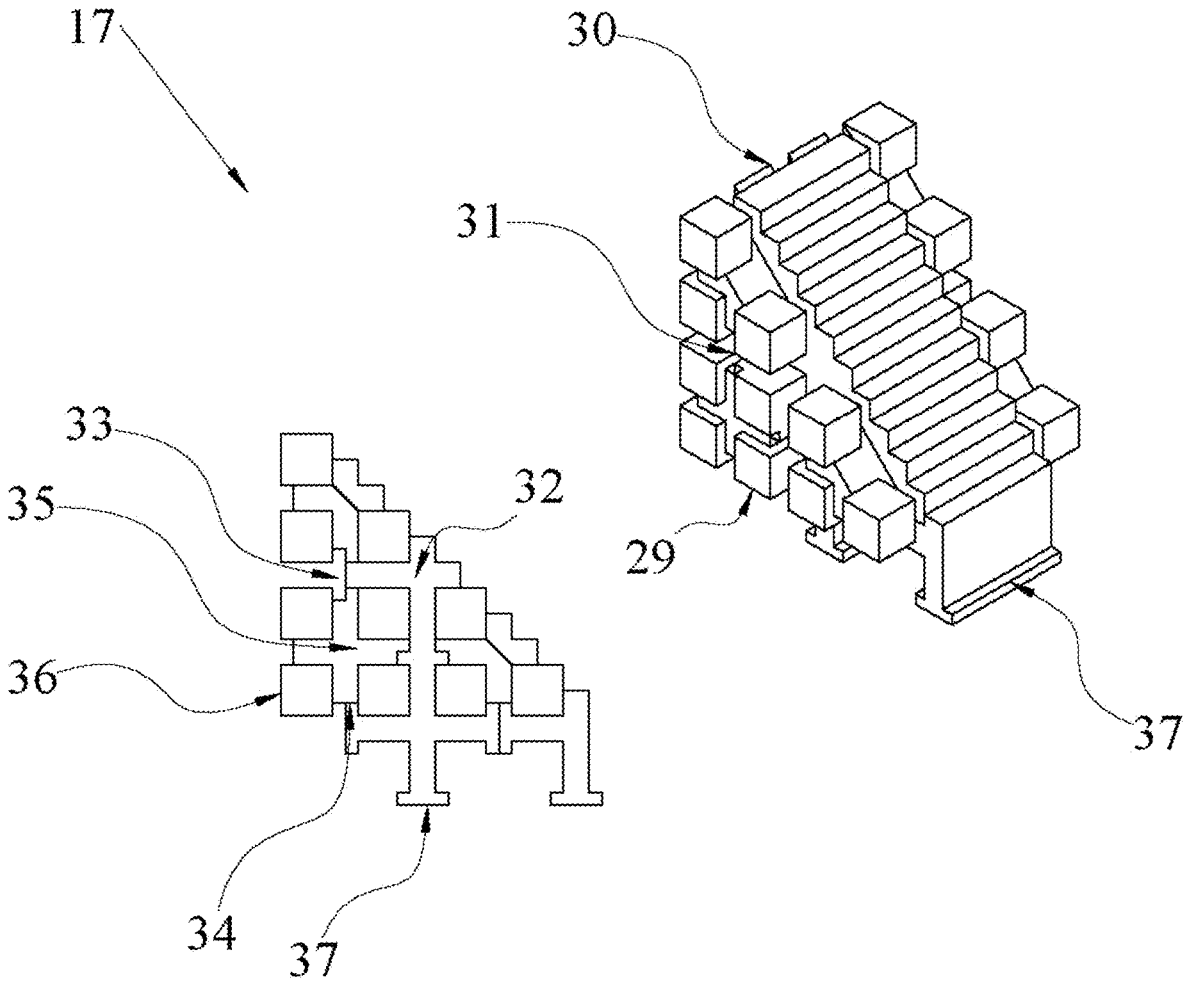
FIG. 9 shows the front, right, and top views of specialized stair cube piece of an example embodiment.
Figure 10:
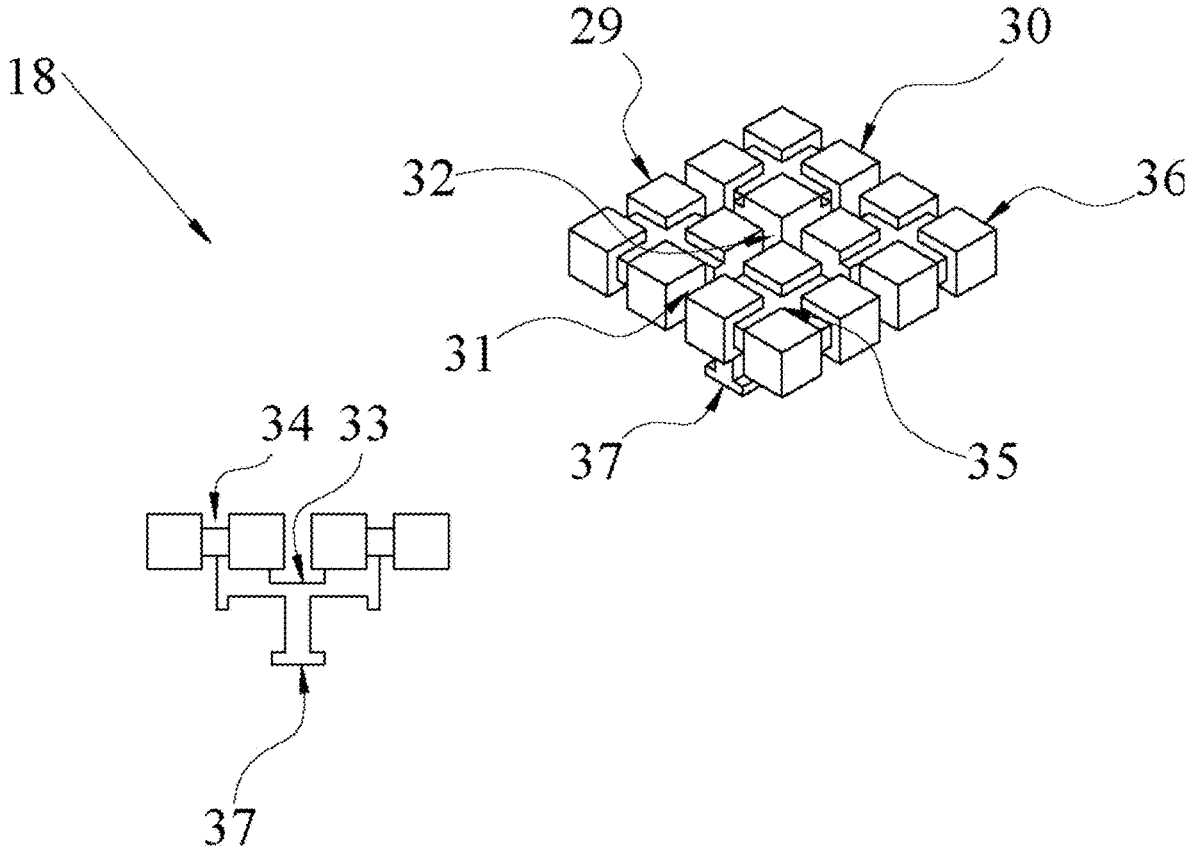
FIG. 10 shows the front, right, and top views of standard single fin cube piece of an example embodiment.
Figure 11:
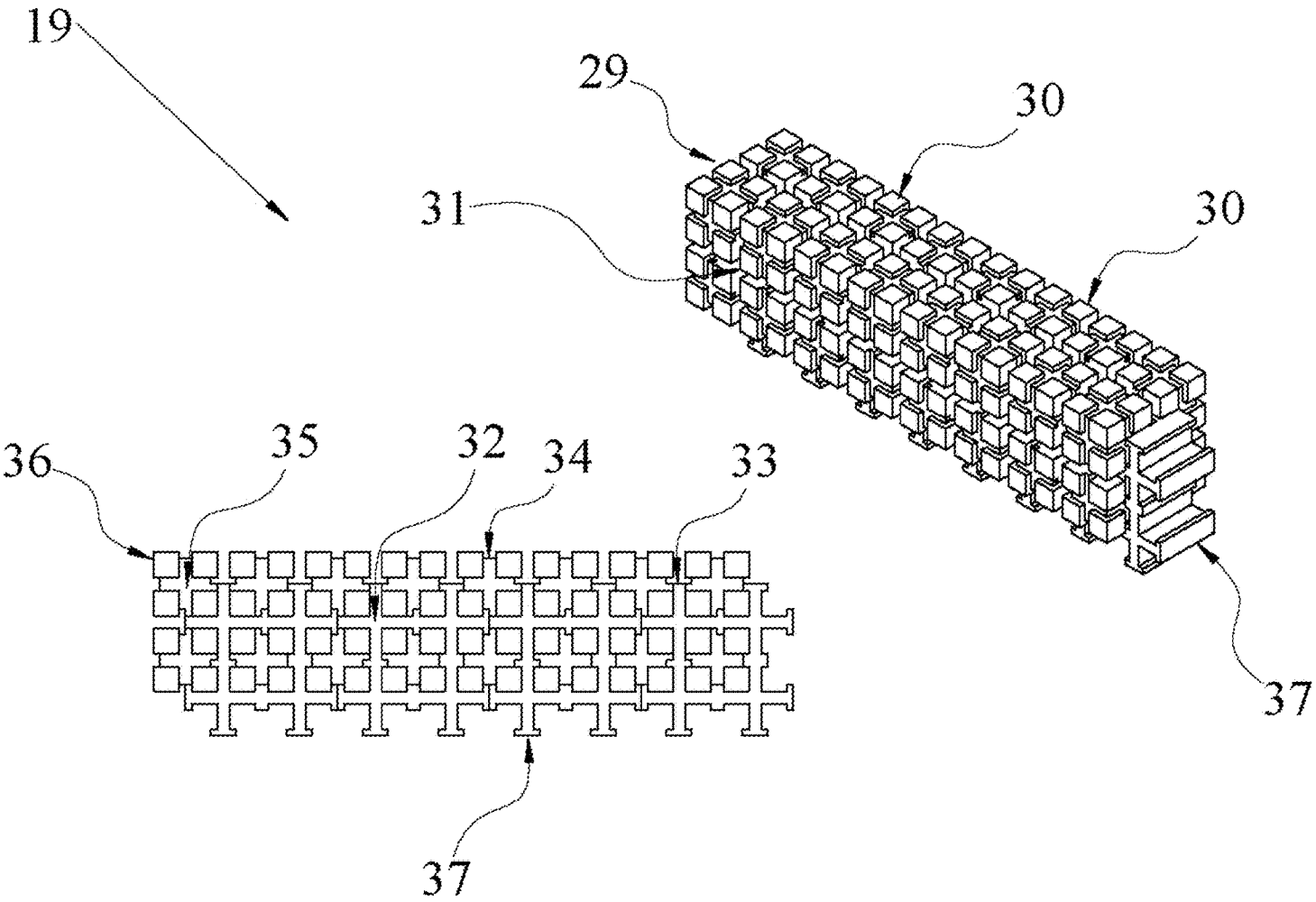
FIG. 11 shows the front, right, and top views of specialized double wide fin base cube piece of an example embodiment.
Figure 13:
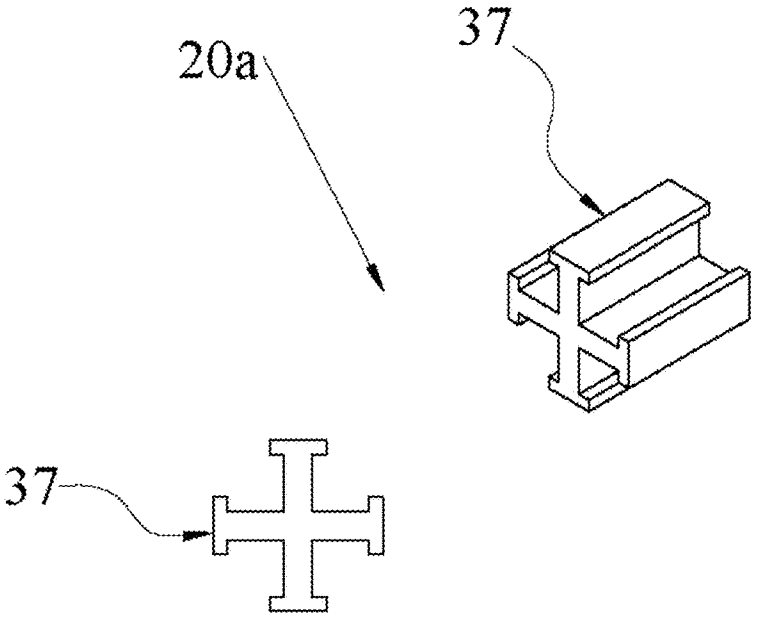
FIGS. 12 and 13 show the front, right, and top views of connectors fin cube piece of an example embodiment.
Figure 12:
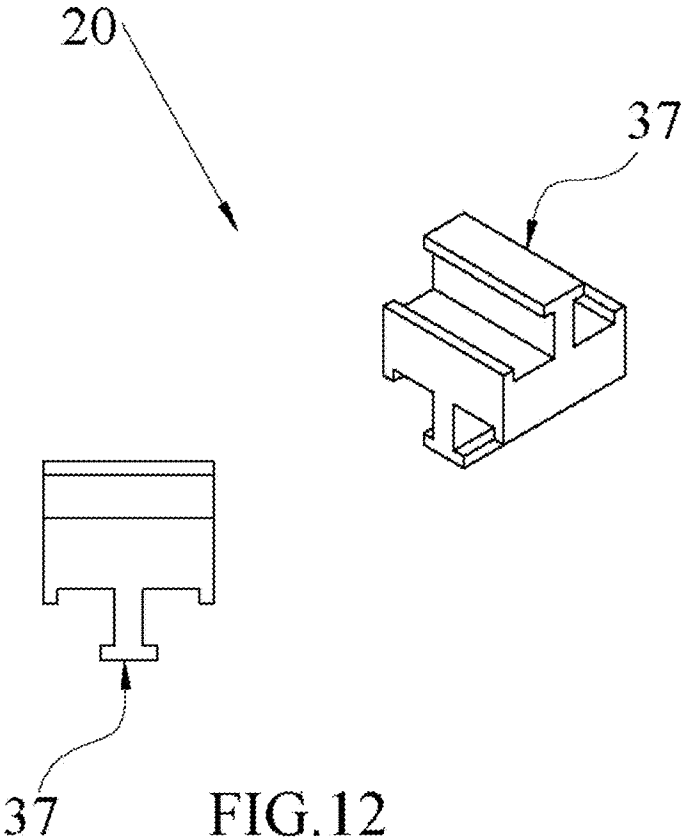

In an example embodiment shown in FIG. 6, the standard cube piece 14 is substantially a six sided cube. Each face 29 of the standard cube piece 14 is composed of sixteen squares 30 that are positioned crosswise. These squares are divided by deep grooves 31. There are two converging center axis grooves 32 on each face 29. These grooves contain a T-shaped undercut 33. The deeper grooves 31 with the undercuts 33 dissect each face 29 of the cube into four quadrants 34 of four squares. All of the grooves continue around the entirety of the standard cube piece 14, on each face 29, and this creates cubes 35 that form the perimeter corners of each face 29. The grooves 31, parallel to one another, shared by two faces 29 in line with, and perpendicular to each other, create a cube-shaped corner 36. The parallel grooves 31 that create two of the edges of these cube-shaped corners 36, act as grip-holds for the slide connector piece 37 (see FIG. 7). As shown in FIGS. 7 through 13, slide connector piece 37 can be formed as a part of the six sided cube. An alternative top surface attachment means, shown in FIGS. 7 through 13, replaces one face 29 with the slide connector 37 allowing for sliding engagement between all faces of the modular cube building block 10.

Figure 14:
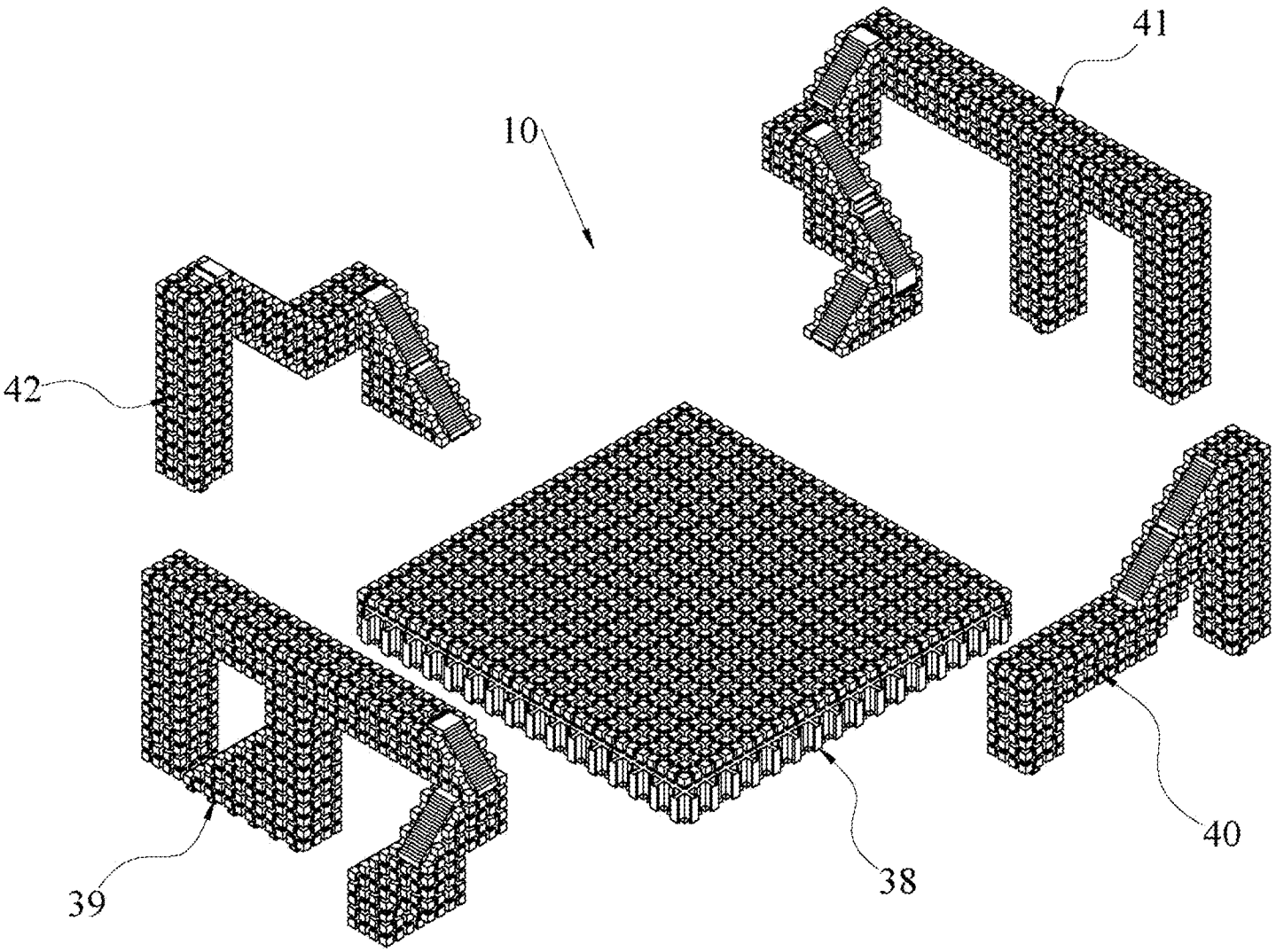
FIG. 14 is a perspective view of the partially assembled structures using the cube pieces in accordance with an example embodiment.
Figure 15:
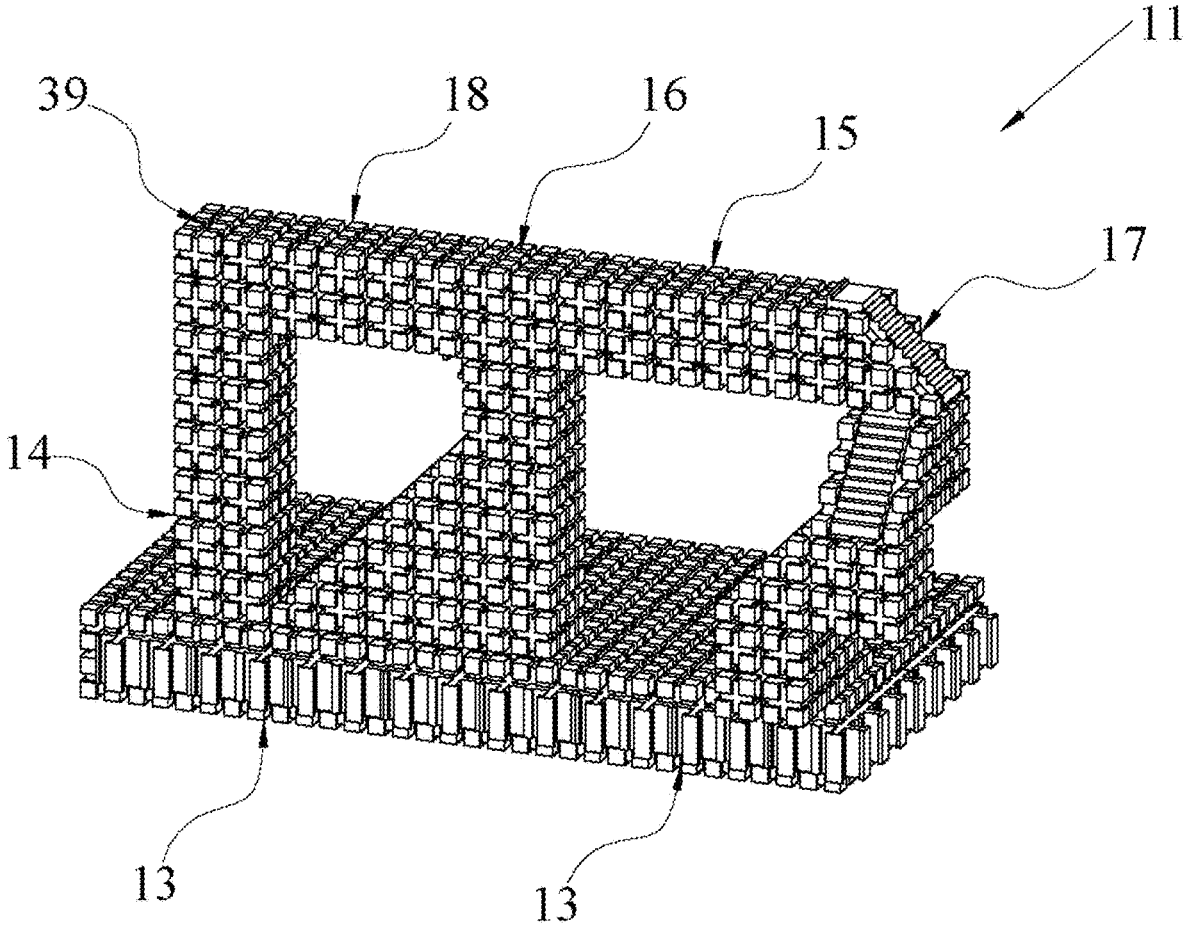
FIG. 15 is a perspective view of one of the possible tower constructed using the cube pieces in accordance with an example embodiment.
Figure 16:
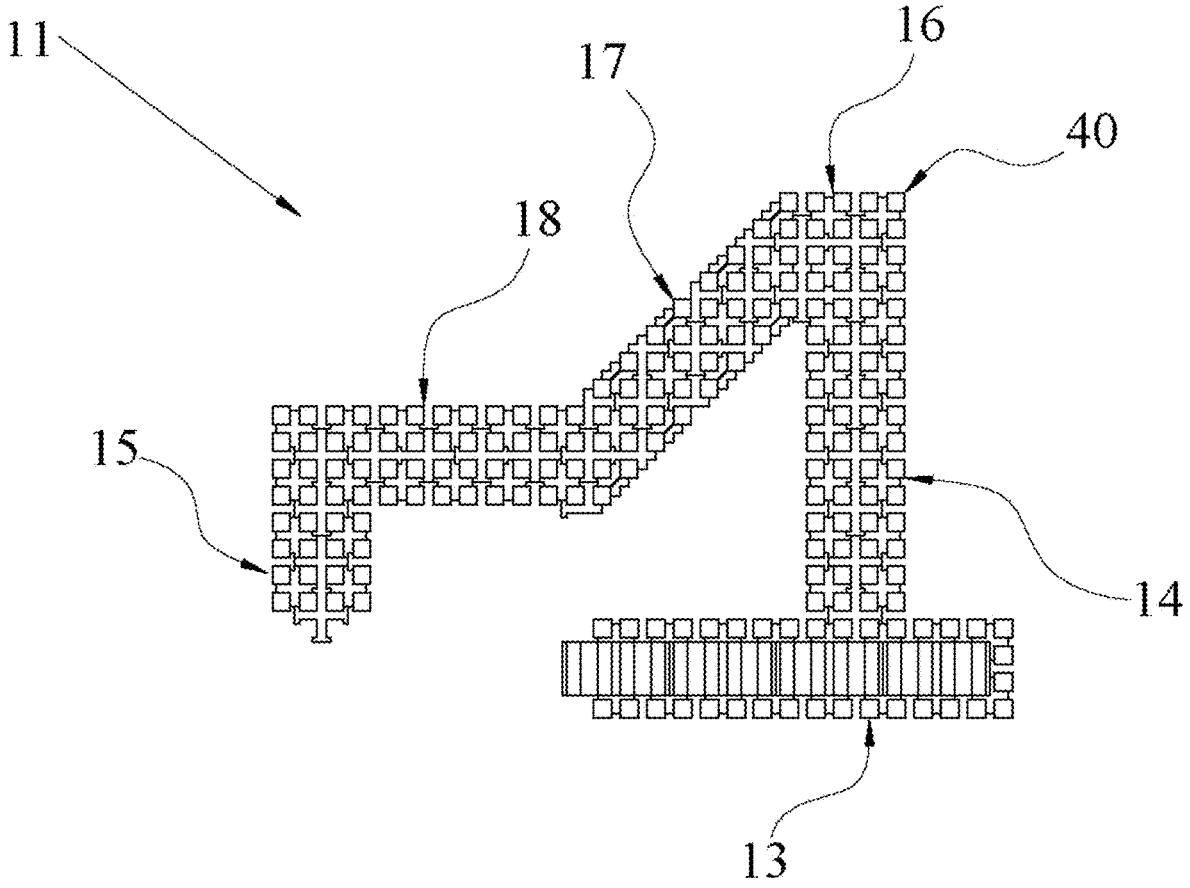
FIG. 16 is a perspective view of one of the possible tower constructed using the cube pieces in accordance with an example embodiment.
Figure 17:
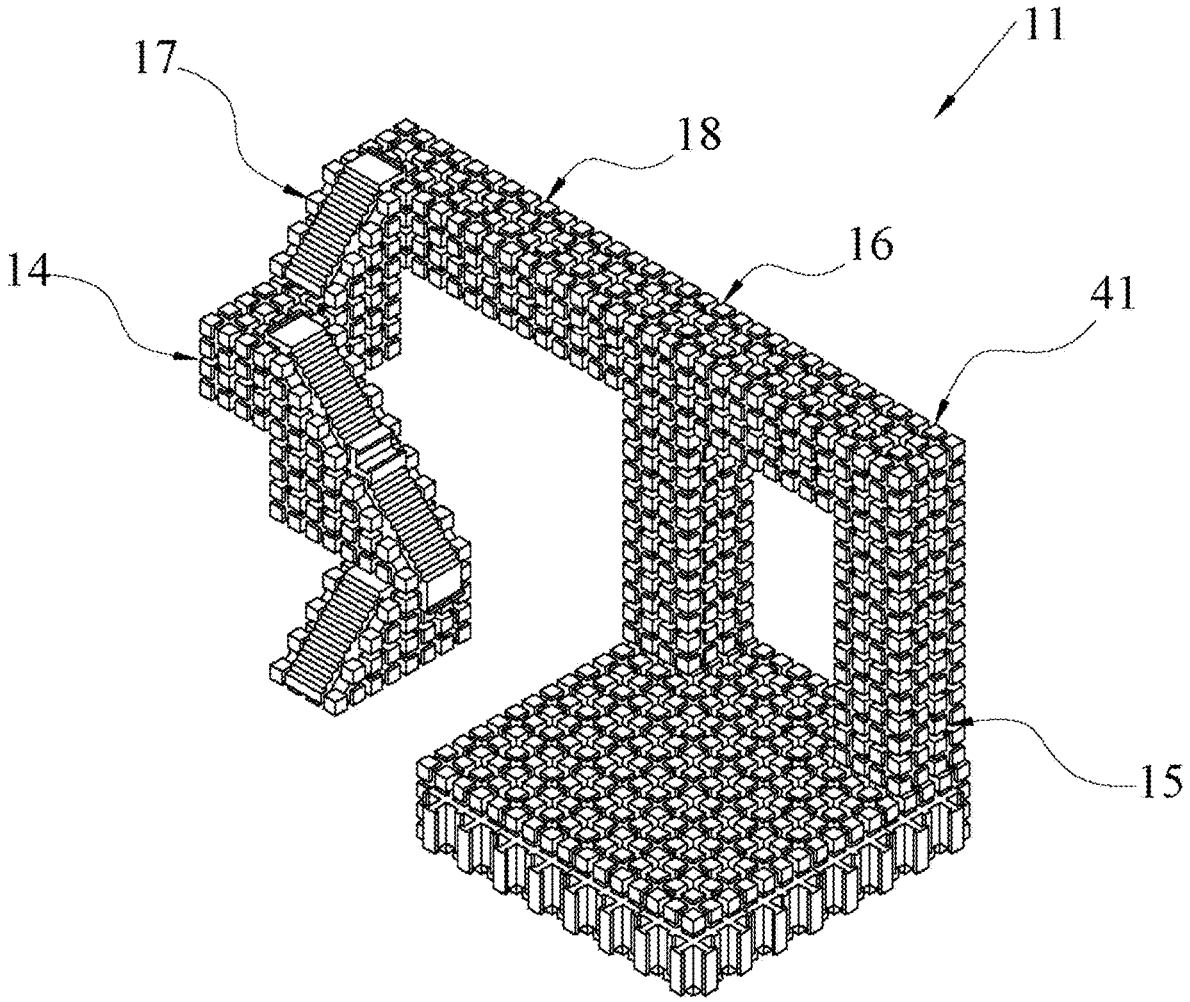
FIG. 17 is a perspective view of one of the possible tower constructed using the cube pieces in accordance with an example embodiment.
Figure 18:
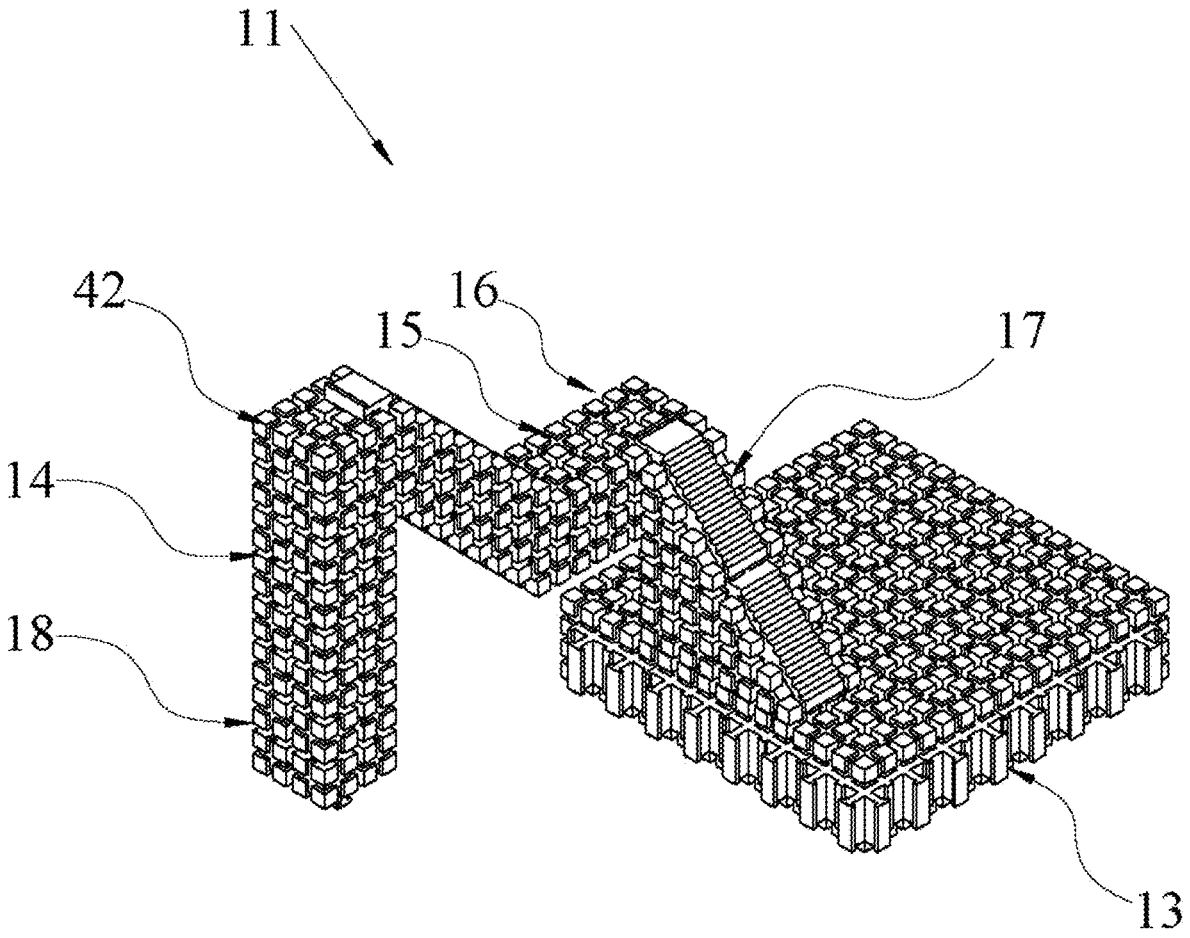
FIG. 18 is a perspective view of one of the possible tower constructed using the cube pieces in accordance with an example embodiment.

With reference to FIG. 14, to assemble the modular cube building block 10, the configuration comprises five separate pieces, which include a pre-assembly cube base plate 38, a pre-assembly modular cube building block A 39, a pre-assembly modular cube building block B 40, a pre-assembly modular cube building block C 41, and a pre-assembly modular cube building block D 42.

The configuration shown in FIGS. 15 through 18 comprises five separate modular cube pieces 11, which include the single cube base plate 13, a standard cube piece 14, specialized single fin cube 15, specialized dual fin cube 16, specialized stair cube 17, and a standard single fin cube 18. The example configurations disclosed above and shown in the included figures show various examples of configurations arranged in such a manner that other configurations can be similarly achieved. This variety of possibilities is what makes the modular cube building block 10 particularly interesting and intellectually stimulating.

Figure 19:
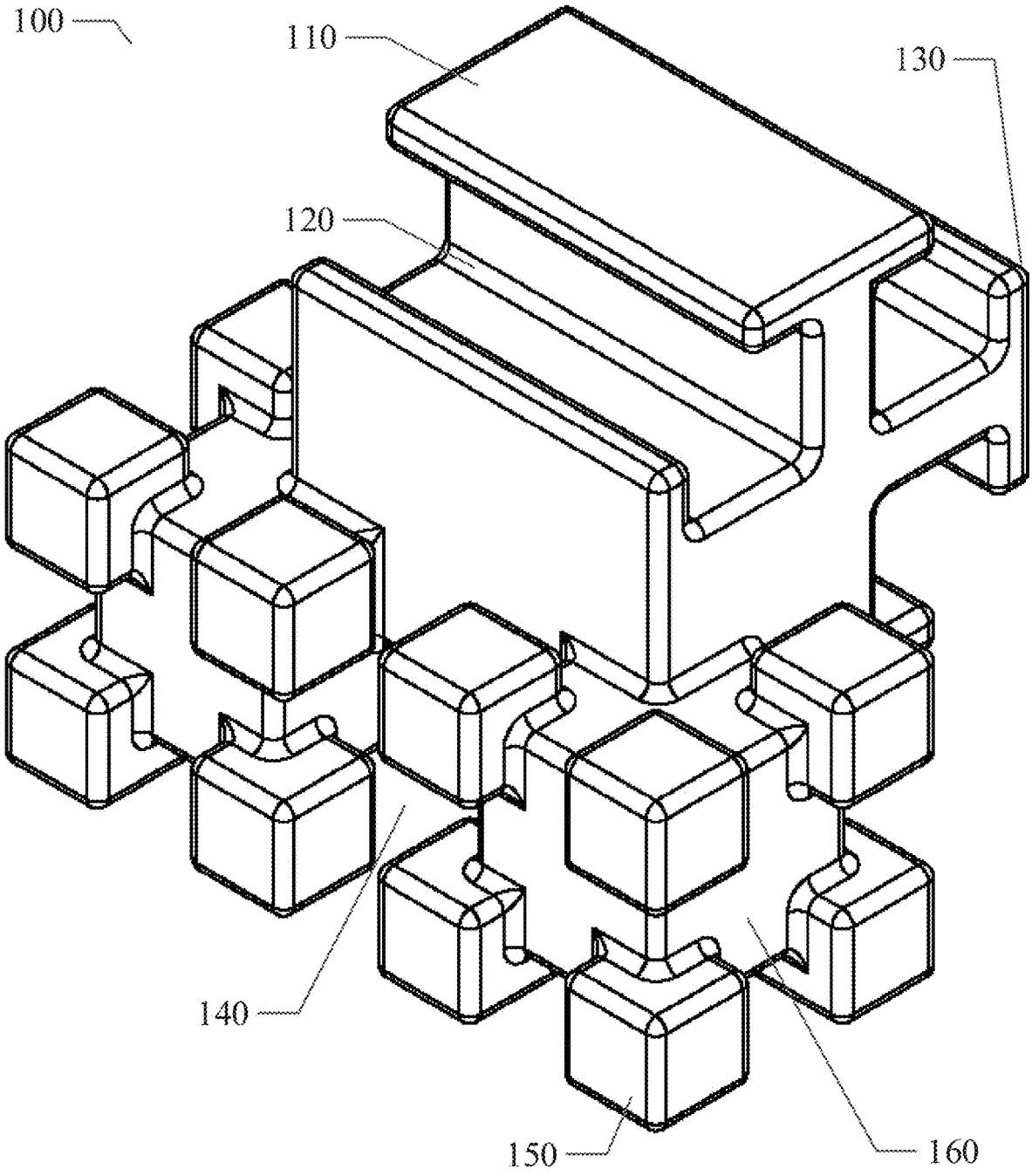
FIG. 19 is a perspective view of a single module in accordance with an example embodiment.

FIG. 19 illustrates a perspective view of a single module 100 in accordance with an example embodiment. In the example embodiment, the single module 100 includes a coupler 110 integrated or attached with a plurality of nodes 150. The coupler 110 is configured to include a coupler channel 120 used to slideably and removably connect the single module 100 to a different single module 100. This slideable and removable connection of two or more single modules 100 is described in more detail below. The single module 100 of the example embodiment also includes fins 130, which also facilitate the slideable and removable connection of two or more single modules 100. The fins 130 and the coupler channel 120 therebetween of a first single module 100 form a pincer grip around the plurality of nodes 150 of a second single module 100. FIG. 19 also illustrates the T-shaped groove or T-groove 140 formed between nodes 150 of the plurality of nodes 150. Intersections 160 are also formed between nodes 150 of the plurality of nodes 150.

Figure 20:
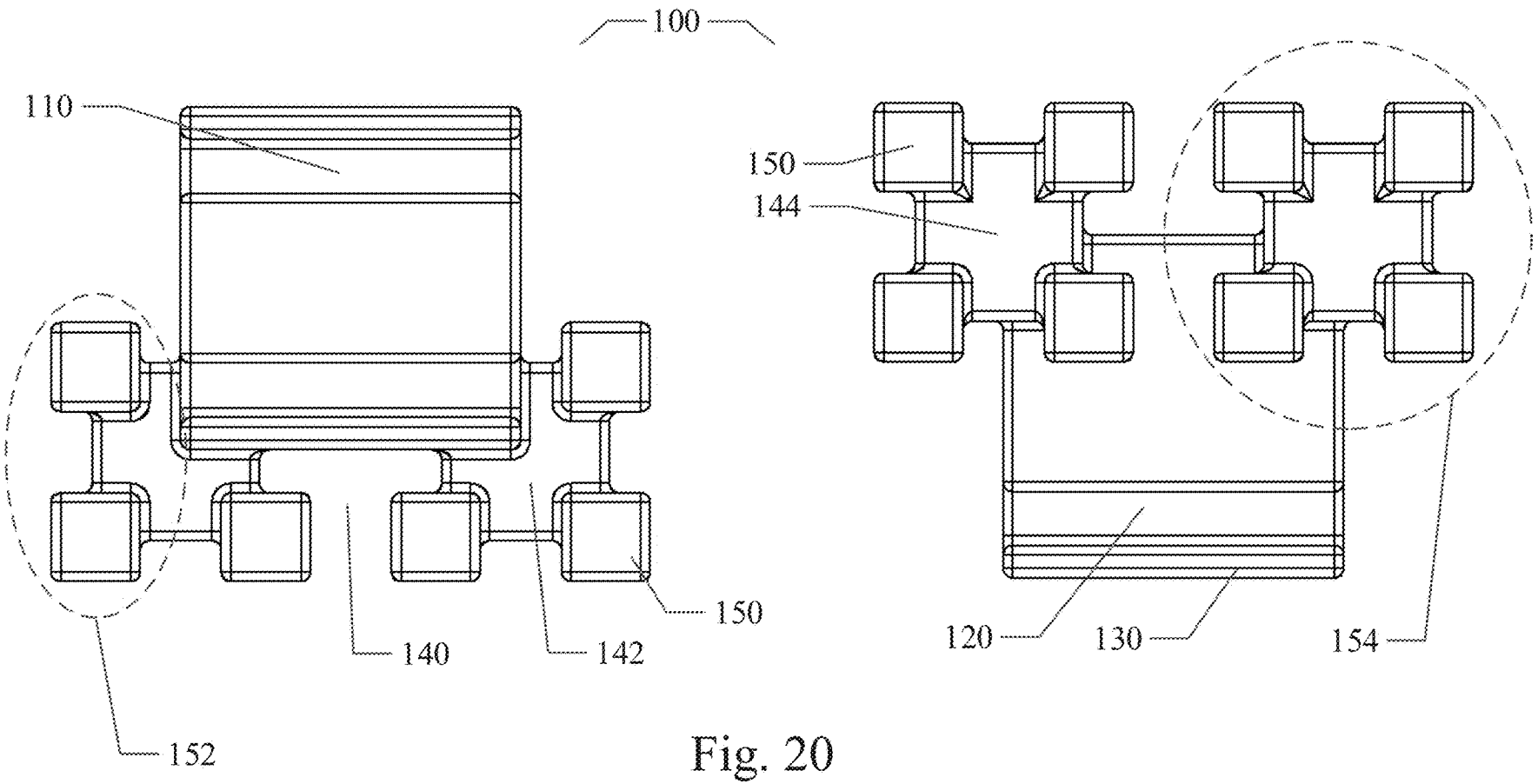
FIG. 20 illustrates front and back views of a single module showing a node group in accordance with an example embodiment.

FIG. 20 illustrates front and back views of a single module 100 showing a node group in accordance with an example embodiment. FIG. 20 shows the coupler 110 integrated or attached with the plurality of nodes 150. FIG. 20 also shows the coupler channel 120, the fins 130, and the T-groove 140. FIG. 20 also shows a node couple 152 representing two adjacent nodes 150 of the plurality of nodes 150. FIG. 20 also shows groove 142 formed between three nodes 150 coupled perpendicularly to each other. FIG. 20 also shows groove intersection 144 between four nodes 150 coupled perpendicularly to each other. FIG. 20 also shows a node group 154 representing four adjacent nodes 150 of the plurality of nodes 150.

Figure 21:
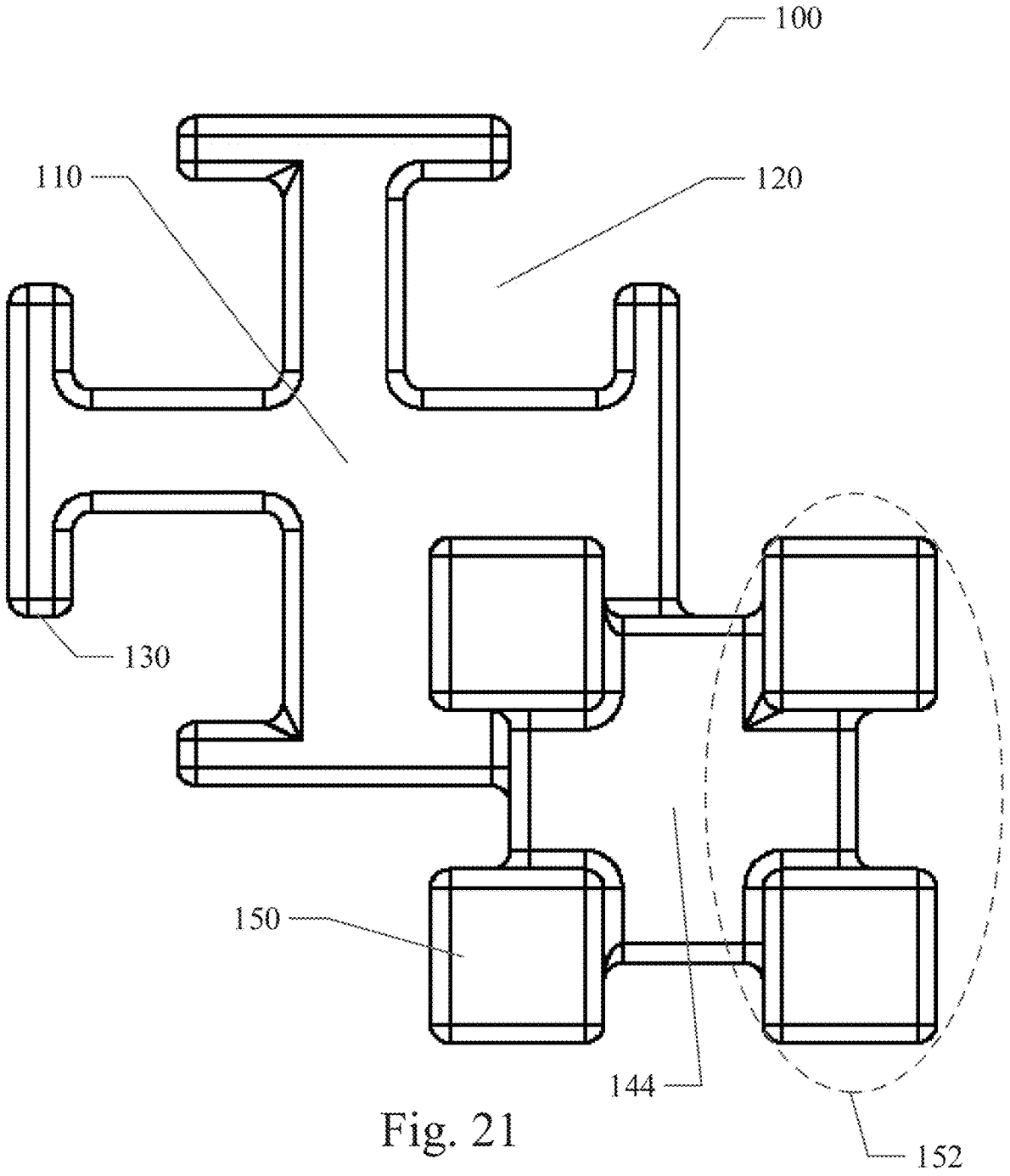
FIG. 21 illustrates a side view of a single module showing a node couple in accordance with an example embodiment.

FIG. 21 illustrates a side view of a single module 100 showing a node couple 152 in accordance with an example embodiment. FIG. 21 shows a side view of the coupler 110 integrated or attached with a plurality of nodes 150. The coupler 110 is configured to include a coupler channel 120 and fins 130 used to slideably and removably connect the single module 100 to a different single module 100. FIG. 20 also shows groove intersection 144 between four nodes 150 coupled perpendicularly to each other.

Figure 22:
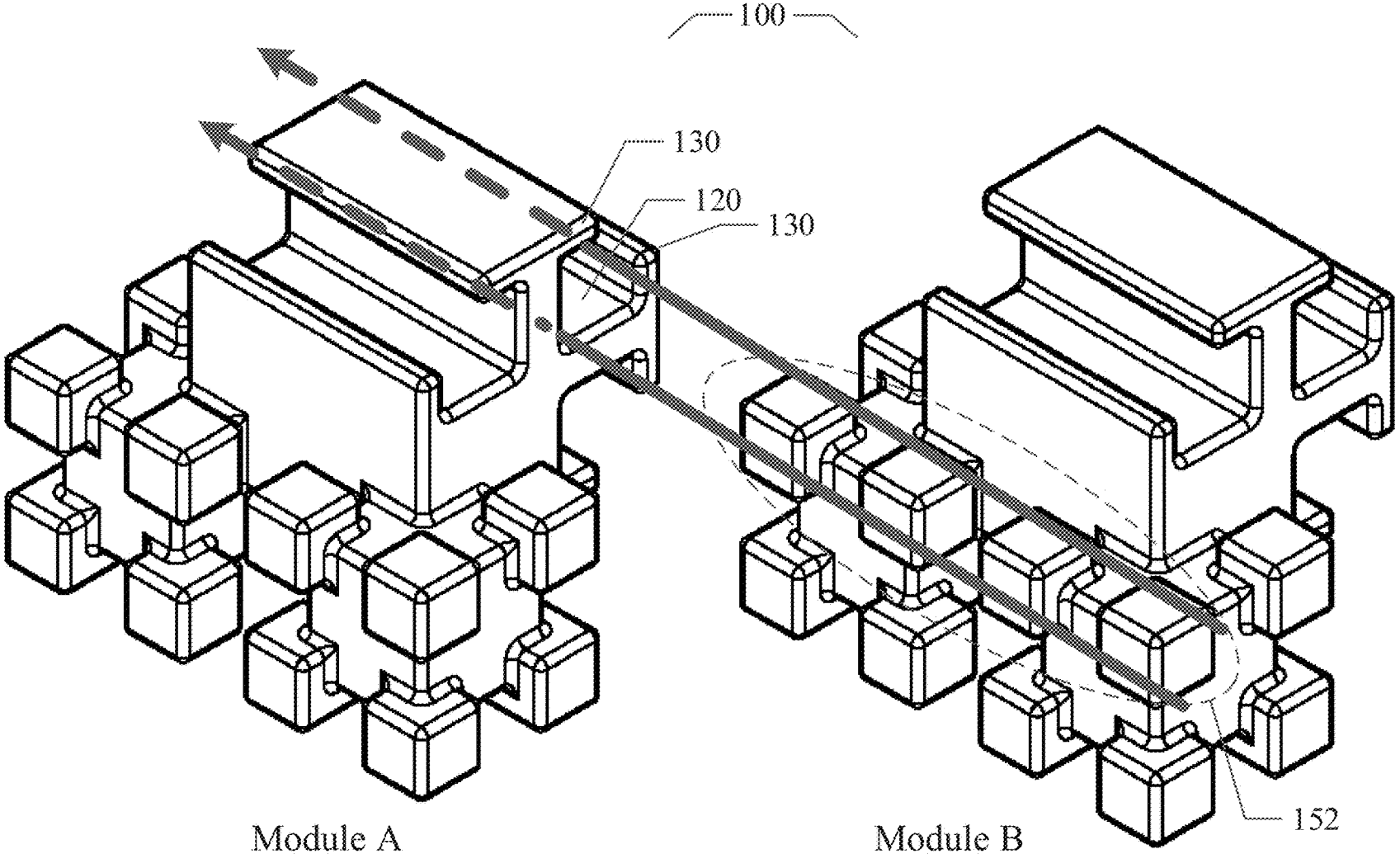
FIGS. 22 and 23 illustrate perspective views of two single modules showing how the two modules can be slid into connection in accordance with an example embodiment.
Figure 23:
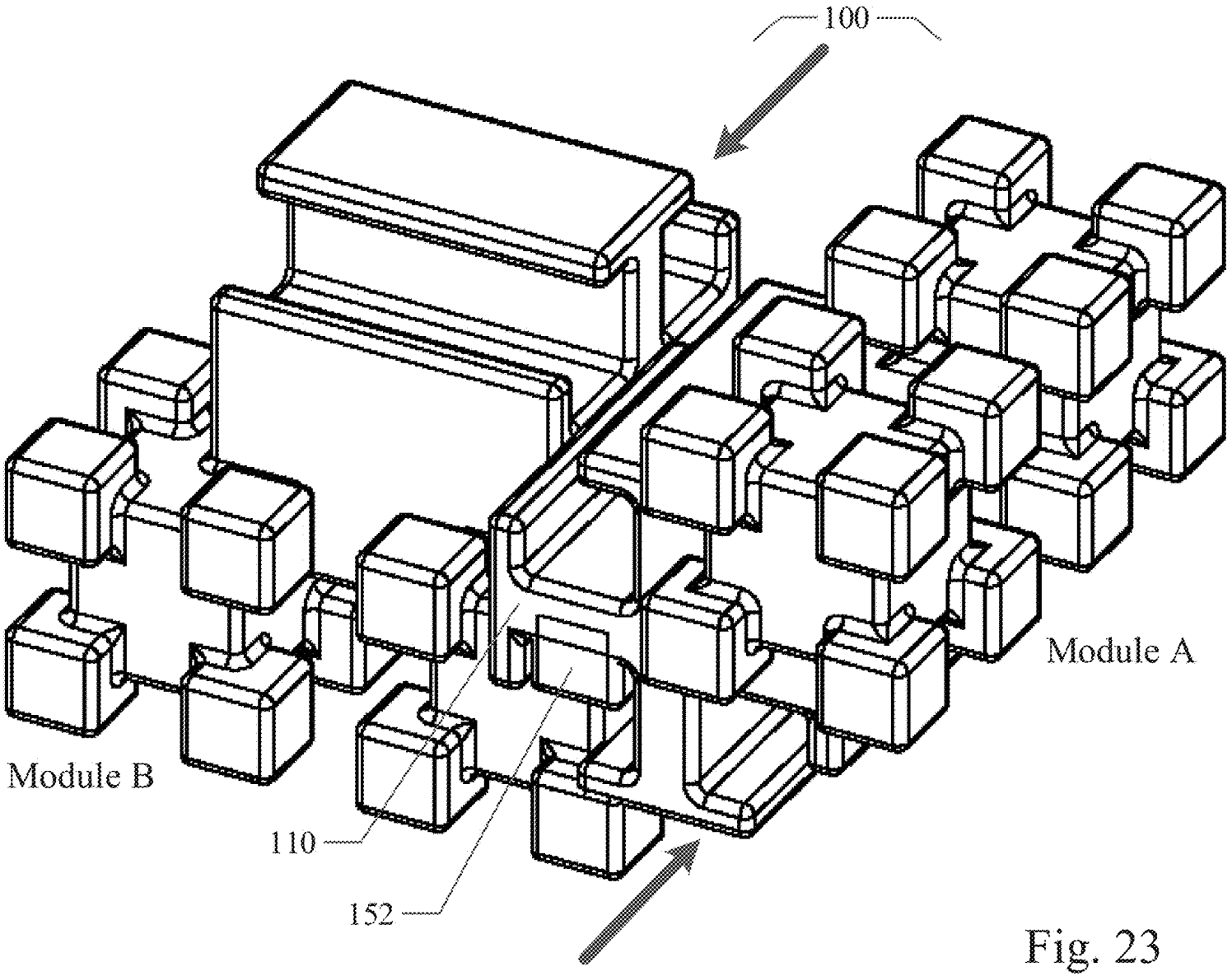

FIGS. 22 and 23 illustrate perspective views of two single modules 100 showing how the two modules 100 can be removably slid into connection in accordance with an example embodiment. As shown, the node group 152 of a single module 100 (e.g., Module B) can be placed and slid into locking position within the coupler channel 120 and between fins 130 of a different single module 100 (e.g., Module A). In this manner, multiple single modules 100 can be removably and sturdily coupled together in a variety of shapes and orientations.

As described herein for various example embodiments, the modular cube building block can comprise: a coupler including a coupler channel formed between a plurality of fins; and a plurality of nodes integrated or attached with the coupler, the plurality of nodes being cubes arranged in orthogonal rows and columns, a space between the plurality of nodes defining a T-channel configured to capture a coupler of a different modular cube building block, the coupler channel configured to capture a node group of a different modular cube building block. The modular cube building block system as described herein can comprise the coupler that includes at least four coupler channels. The modular cube building block system as described herein can comprise the plurality of nodes having at least eight nodes. The modular cube building block system as described herein can comprise the plurality of nodes including at least two nodes groups. The modular cube building block system as described herein can comprise at least one node of the plurality of nodes that extends beyond a face of the coupler. The modular cube building block system as described herein can comprise the coupler of a first modular cube building block that is configured for slideable and removable insertion into the T-channel of a second modular cube building block. The modular cube building block system as described herein can comprise the node group of a first modular cube building block that is configured for slideable and removable insertion into the coupler channel of a second modular cube building block. The modular cube building block system as described herein can comprise the node group that includes at least two nodes. The modular cube building block system as described herein can comprise the cubes of the plurality of nodes having rounded edges. In various example embodiments, the modules, blocks, or cubes can be fabricated from a variety of materials including plastic, wood, metal, ceramic, rubber, or any other rigid material. The modules, blocks, or cubes can be fabricated using conventional techniques, such as injection molding, 3D printing, or other manufacturing processes.

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used only for descriptive purposes and not to be construed as limiting. The elements, materials, geometries, dimensions, and sequence of operations may all be varied for particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, a modular cube building block system is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A modular cube building block comprising:

a coupler including a coupler channel formed between a plurality of fins; and a plurality of nodes integrated or attached with the coupler, the plurality of nodes being cubes arranged in orthogonal rows and columns, a space between the plurality of nodes defining a T-channel configured to capture a coupler of a different modular cube building block, the coupler channel configured to capture a node group of a different modular cube building block.

2. The modular cube building block system of claim 1 wherein the coupler includes at least four coupler channels.

3. The modular cube building block system of claim 1 wherein the plurality of nodes includes at least eight nodes.

4. The modular cube building block system of claim 1 wherein the plurality of nodes includes at least two nodes groups.

5. The modular cube building block system of claim 1 wherein at least one node of the plurality of nodes extends beyond a face of the coupler.

6. The modular cube building block system of claim 1 wherein the coupler of a first modular cube building block is configured for slideable and removable insertion into the T-channel of a second modular cube building block.

7. The modular cube building block system of claim 1 wherein the node group of a first modular cube building block is configured for slideable and removable insertion into the coupler channel of a second modular cube building block.

8. The modular cube building block system of claim 1 wherein the node group includes at least two nodes.

9. The modular cube building block system of claim 1 wherein the cubes of the plurality of nodes having rounded edges.

10. The modular cube building block system of claim 1 wherein the modular cube building block is fabricated from a material from the group consisting of: plastic, wood, metal, ceramic, and rubber.

* * * * *